United States Patent [19]

Moriya et al.

[11] 4,378,000

[45] Mar. 29, 1983

[54] FUEL SUPPLY DEVICE FOR INTERNAL COMBUSTION ENGINE

[75] Inventors: Hisanori Moriya; Takeshi Atago, both of Katsuta, Japan

[73] Assignee: Hitachi, Ltd., Tokyo, Japan

[21] Appl. No.: 245,176

[22] Filed: Mar. 18, 1981

[30] Foreign Application Priority Data

Mar. 19, 1980 [JP] Japan ..... 55-35559

[51] Int. Cl.[3] ..... F02M 39/00

[52] U.S. Cl. ..... 123/442; 123/445; 261/44 F; 261/64 B

[58] Field of Search ..... 123/442, 445, 301, 302, 123/585, 586; 261/44 F, 50 A, 64 B, 82

[56] References Cited

U.S. PATENT DOCUMENTS

| | | | |
|---|---|---|---|
| 2,457,570 | 12/1948 | Leibing | 261/50 A |
| 3,322,408 | 5/1967 | Stoltman | 261/44 F |
| 3,807,367 | 4/1974 | Lamm | 123/442 |
| 3,827,411 | 8/1974 | Lamm et al. | 123/442 |
| 4,308,837 | 1/1982 | Nohira et al. | 123/52M |

FOREIGN PATENT DOCUMENTS

| | | | |
|---|---|---|---|
| 433083 | 8/1926 | Fed. Rep. of Germany | 123/586 |

*Primary Examiner*—Charles J. Myhre
*Assistant Examiner*—Magdalen Moy
*Attorney, Agent, or Firm*—Antonelli, Terry & Wands

[57] ABSTRACT

A fuel supply device for an internal combustion engine having an intake manifold includes a throttle body defining therein an intake passage communicating at one end thereof with the intake manifold. A flow accelerating valve arranged in the intake passage upstream of a throttle valve cooperates with the wall surface of the intake passage to define a flow accelerating passage of a smaller flow area than the intake passage. The flow accelerating valve is angularly movable in response to a change in the intake fluid flow between a fully closed position in which the flow accelerating passage has a minimum flow area and a fully open position in which the flow accelerating passage has a maximum flow area, to thereby control the flow area of the flow accelerating passage. A fuel injector injects liquid fuel into the accelerated intake fluid flow passing through the flow accelerating passage.

12 Claims, 7 Drawing Figures

FUEL SUPPLY DEVICE FOR INTERNAL COMBUSTION ENGINE

BACKGROUND OF THE INVENTION

1. Field of the Invention

This invention relates to a fuel supply device for an internal combustion engine, including a fuel injector for injecting pressurized liquid fuel.

2. Description of the Prior Art

A so-called multi-point fuel injection system for an internal combustion engine is known which comprises a plurality of fuel injectors each mounted in one of a plurality of branch pipes of an intake manifold respectively communicating with a plurality of cylinders of the engine. Due to the fact that this multi-point fuel injection system has a plurality of fuel injectors and means for controlling fuel injections effected by the plurality of fuel injectors is complex in construction, the problem has arisen that a fuel supply system including the fuel injection system is high in cost. To obviate this problem, proposals have been made to use what is generally referred to as a single-point fuel injection system which comprises a single fuel injector arranged upstream or downstream of a throttle valve mounted in an intake passage defined in a throttle body. However, the single-point fuel injection system having its fuel injector disposed downstream of the throttle valve suffers the disadvantage that because the fuel injector is directly influenced by variations in the negative or subatmospheric pressure in the intake manifold, means for effecting control of fuel injections by the single fuel injector becomes complex in construction, thereby causing an increase in cost of the fuel supply system.

A throttle body fuel injection system having a fuel injector arranged upstream of a throttle valve as disclosed in U.S. Pat. No. 4,130,095, for example, has another problem that, since the intake fluid flow through the intake passage upstream of the throttle valve at an idling operation of engine and at a high-load and low rotational speed of engine has a low speed, the liquid fuel injected from the fuel injector is not sufficiently atomized to change the liquid fuel into a mist of uniformly broken-down minuscule particles of fuel and uniform fuel-air mixtures are unobtainable.

It would be possible to reduce cost in producing the fuel supply system, if the pressure at which the liquid fuel is injected from the fuel injector is lowered. However, it would be impossible to obtain uniform fuel-air mixtures if the pressure at which the liquid fuel is injected is lowered, because this would make it impossible to obtain sufficient atomization of the liquid fuel to change the liquid fuel into a mist of uniformly broken-down minuscule particles of fuel.

SUMMARY OF THE INVENTION

An object of this invention is to provide a fuel supply device for an internal combustion engine capable of reducing the cost of a fuel supply system as a while.

Another object is to provide a fuel supply device which enables enough atomization of the liquid fuel to be obtained in spite of the fact that the pressure at which the liquid fuel is injected is lowered.

Yet another object is to provide a fuel supply device capable of feeding uniform fuel-air mixtures to the engine to permit combustion in engine combustion chambers to take place effectively in good condition.

A further object is to provide a fuel supply device capable of feeding uniform fuel-air mixtures to the engine to thereby reduce harmful constituents in exhaust emissions.

A still further object is to provide a fuel supply device lending itself to ready assembling in a fuel supply system of the prior art without essentially modifying the same.

According to the invention, there is provided a fuel supply device for an internal combustion engine including an intake manifold, comprising a throttle body defining therein an intake passage having one end thereof communicating with the intake manifold, and a throttle valve in the intake manifold for controlling intake fluid flow introduced into the engine through the intake passage and the intake manifold. A accelerating means is disposed in the intake passage upstream of the throttle valve, with the flow accelerating means cooperating with the wall surface of the intake passage to define therein an accelerating flow passage having its flow area less than that of the intake passage. The intake fluid flow passing through the intake passage is accelerated when the intake fluid flow passes through the accelerating flow passage. The flow accelerating means is movable in response to a change in the intake fluid flow introduced into the engine through the intake passage between a fully closed position in which the accelerating passage has a minimum flow area and a fully open position in which the accelerating flow passage has a maximum flow area, to control the flow area of the accelerating flow passage. A fuel injector includes a nozzle disposed upstream of the throttle valve and downstream of the flow accelerating means when it is in its fully closed position with the fuel injector injecting liquid fuel through the nozzle into the accelerated intake fluid flow passing through the accelerating flow passage.

DETAILED DESCRIPTION OF THE PREFFERED EMBODIMENTS

Figure 1:
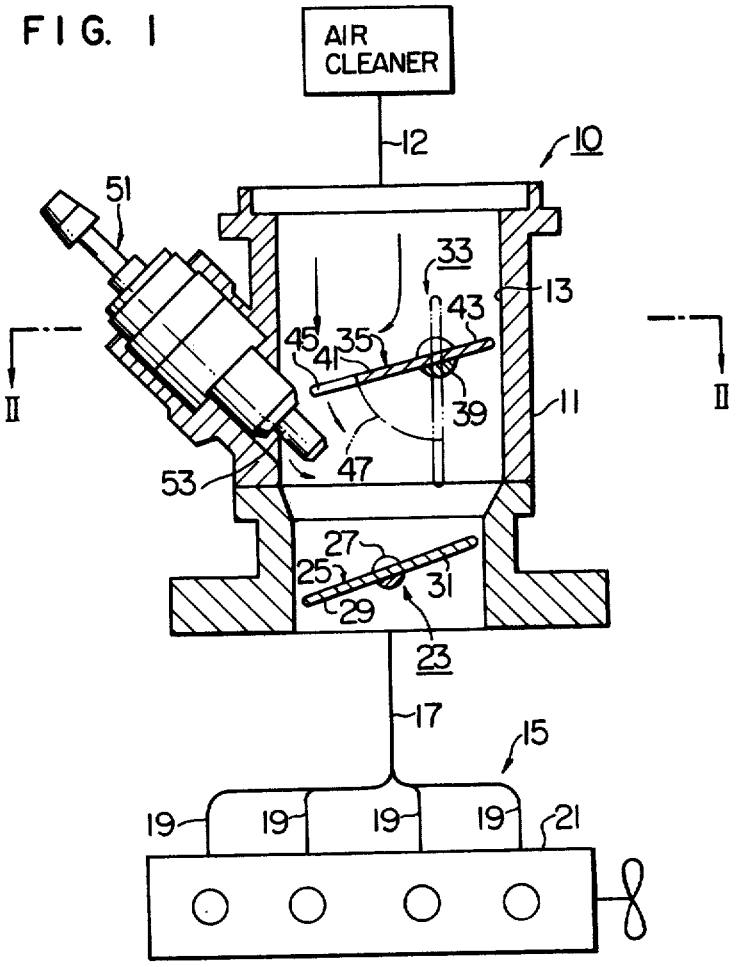
FIG. 1 is a longitudinal sectional view of the fuel supply device in accordance with one embodiment of the invention.
Figure 2:
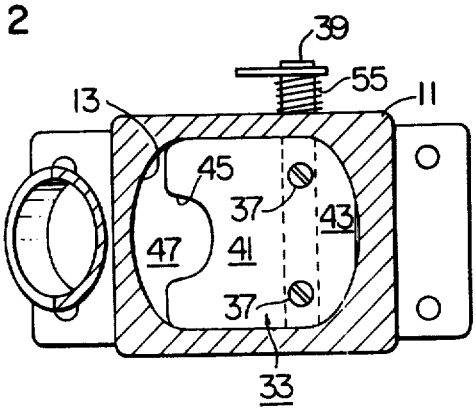
FIG. 2 is a sectional view taken along the line II—II in FIG. 1, showing the fuel supply device with the fuel injector being removed.

Referring to FIGS. 1 and 2, the fuel supply device according to the invention generally designated by the numeral 10 comprises a throttle body 11 defining therein an intake passage 13 communicating at one end thereof with a conventional conduit 12 connected to an air cleaner and at the other end thereof with a conventional intake manifold generally designated by the reference numeral 15 which is schematically shown. The intake manifold 15 includes a collector pipe 17 and branch pipes 19 respectively connected to cylinders of an engine 21 schematically shown. The throttle body 11 can be connected to the conventional conduit 12 connected to the air cleaner and to the collector pipe 17 of the conventional manifold 15 without in any way modifying the constructions of these conventional structures.

A throttle valve generally designated by the reference numeral 23 is arranged in the intake passage 13 and is angularly movable in interlocking relationship to an accelerator pedal of a vehicle, not shown, to control intake fluid flow through the intake passage 13 and the intake manifold 15 into the engine 21. The throttle valve 23 includes a planar plate generally designated by the reference numeral 25 of a shape substantially complementary to the cross-sectional configuration of the intake passage 13, and a shaft 27 secured to the planar plate 25 and rotatably supported by the throttle body 11. The shaft 27 has an axis thereof extending perpendicular to the longitudinal axis of the intake passage 13 and the planar plate 25 into two halves 29 and 31 of substantially the same surface area.

A flow accelerating valve generally designated by the reference numeral 33 is arranged in the intake passage 13 upstream of the throttle valve 23. The flow accelerating valve 33 includes a planar plate generally designated by the reference numeral 35, and a shaft 39 fastened to the planar plate 35 by screws 37 (FIG. 2) and rotatably supported by the throttle body 11. The shaft 39 has an axis thereof extending perpendicular to the longitudinal axis of the intake passage 13 and divides the planar plate 35 into two plate sections 41 and 43, one plate section 41 having a larger surface area than the other plate section 43. The one plate section 41 is formed with an indentation 45 which cooperates with the wall surface of the intake passage 13 to define therein an accelerating flow passage 47 smaller in flow area than that of the intake passage 13. Due to the difference in area between the one plate section 41 and the other plate section 43, the planar plate 35 is angularly movable in response to a change in the intake fluid flow through the intake manifold 15 into the engine 21 between a fully closed position shown in solid lines in FIG. 1, in which the accelerating flow passage 47 has a minimum flow area and a fully open position shown in dash-and-dot lines in FIG. 1, in which the accelerating flow passage 47 has a maximum flow area, to control the flow area of the accelerating passage 47.

A fuel injector generally designated by the reference numeral 51, capable of injecting liquid fuel at a constant injection pressure in the range between 0.7 and 1.0 kg/cm$^2$, includes a nozzle 53, a valve, not shown, cooperating with the nozzle 53, and an electromagnetic actuator, not shown, for operating the valve. The nozzle 53 has a tip disposed upstream of the throttle valve 23 and downstream of the flow accelerating valve 33 when the latter is in its fully closed position. The nozzle 53 is directed against the throttle valve 23, preferably against the half portion 31 of the planar plate 25 of the throttle valve 23 remote from the nozzle 53, to eject the liquid fuel therethrough against the surface of the half portion 31 of the planar plate 25.

As clearly shown in FIG. 2, a coil spring 55 is mounted in concentric relation at one end portion of the shaft 39 of the flow accelerating valve 33 which projects out of the throttle body 11, to normally urge the flow accelerating valve 33 to move to its fully closed position.

At engine idling operation with the throttle valve 23 disposed near its fully closed position, the flow accelerating valve 33 is disposed in its fully closed position shown in solid lines in FIG. 1. Air introduced through the air cleaner into one end of the intake passage 13 passes to the accelerating flow passage 47 of smaller flow area where the air flow is accelerated. The accelerated fluid flow passes around the nozzle 53 and through the throttle valve 23 into the intake manifold 15 from which it is led to the engine 21. Meanwhile liquid fuel is injected through the nozzle 53 into the accelerated fluid flow passing through the accelerating flow passage 47. In spite of the liquid fuel injecting pressure being relatively low or in the range between 0.7 and 1.0 kg/cm$^2$, it is possible to obtain uniform fuel-air mixtures in the intake passage 13 because the liquid fuel is injected into the accelerated fluid flow and atomized into uniformly broken-down minuscule particles of fuel suitable for producing the uniform fuel-air mixtures. The liquid fuel, which is in the form of droplets of a relatively large size when released from the nozzle 53, is blown against the surface of the half portion 31 of the throttle valve 23 and flows therealong. The liquid fuel flowing along the surface of the half portion 31 is atomized when it reaches the edge of the planar plate 25 by the stream of a fuel-air mixture flowing through the gap between the outer periphery of the planar plate 25 and the wall surface of the intake passage 13, to ensure that the fuel-air mixtures introduced into the engine 21 through the intake manifold 15 are uniform.

With an increase in the opening of the throttle valve 23 and an increase in the rotational speed of the engine 21, the intake fluid flow through the intake passage 13 increases. Upon the intake fluid flow reaching a predetermined value, the flow accelerating valve 33 is angularly moved, against the biasing force of the coil spring 55, from its fully closed position shown in solid lines in FIG. 1 toward its fully open position shown in dash-and-dot lines in the figure. Stated differently, an increase in the intake fluid flow causes the flow accelerating valve 33 to angularly move toward its fully open position to thereby increase the flow area of the flow accelerating passage 47. The greater the increase in the flow area of the flow accelerating passage 47, the smaller becomes the flow accelerating effect achieved by the flow accelerating passage 47. However, the fluid flow causing the flow accelerating valve 33 to move toward its fully open position against the biasing force of the coil spring 55 has a sufficiently high speed to properly atomize the liquid fuel injected through the nozzle 53 into the intake fluid flow in the intake passage.

At high-load, low rotational speed of the engine 21, the intake fluid flow through the intake passage 13 is small and the flow accelerating valve 33 moves near to its fully closed position. The fluid flow through the accelerating flow passage 47 is sufficiently accelerated to properly atomize the liquid fuel injected through the nozzle 53.

Figure 3:
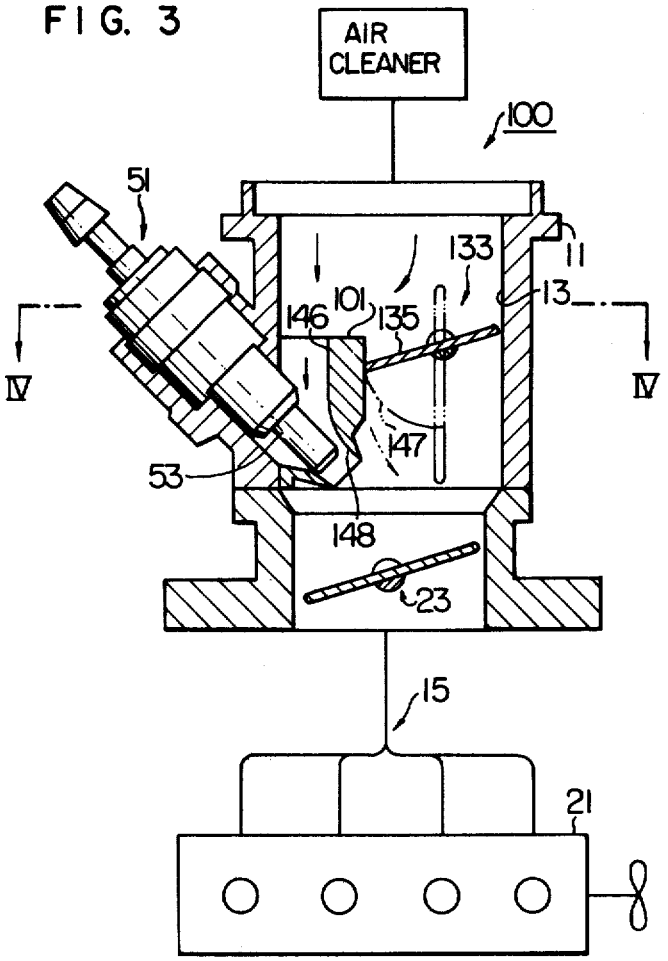
FIG. 3 is a longitudinal sectional view of the fuel supply device in accordance with another embodiment of the invention.
Figure 4:
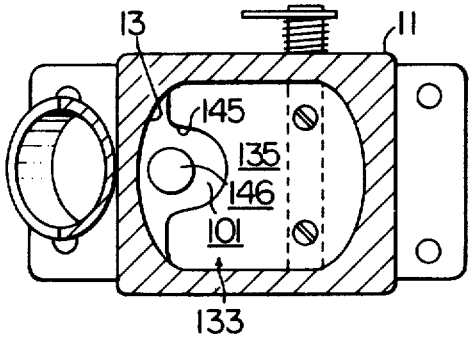
FIG. 4 is a sectional view taken along the line IV—IV in FIG. 3, showing the fuel supply device with the fuel injector being removed.

Referring to FIGS. 3 and 4, there is shown a fuel supply device in accordance with another embodiment of the invention generally designated by the numeral 100. In FIGS. 3 and 4, like reference characters designate parts similar to those shown in FIGS. 1 and 2 and their detailed description will be omitted.

The fuel supply device 100 shown in FIGS. 3 and 4 is different from the fuel supply device 10 shown in FIGS. 1 and 2 in that a partition wall member 101 is mounted on the wall surface of the intake passage 13 defined in the throttle body 11 and divides the accelerating flow passage defined by the flow accelerating valve generally designated by the reference numeral 133 into a first flow passage section 146 and a second flow passage section 147. More specifically, the partition wall member 101 has an inner surface cooperating with the wall surface of the intake passage 13 to define the first flow passage section 146 of a fixed flow area, and an outer surface cooperating with an indentation 145 formed in the periphery of the planar plate 135 to define the second flow passage section 147 of a variable flow area.

The first flow passage section 146 includes a downstream end portion 148 having a substantially cylindrical wall surface, and the nozzle 53 of the fuel injector 51 is disposed in substantially concentric relation to a part of the downstream end portion 148 of the first flow passage section 146 in such a manner that an annular clearance is formed between the outer periphery of the nozzle 53 and the cylindrical wall surface of the downstream end portion 148.

The flow accelerating valve 133 is angularly movable in response to the intake fluid flow introduced into the engine 21 to vary the flow area of the second flow passage section 147, to thereby control the flow area of the accelerating flow passage constituted by the first flow passage section 146 and the second flow passage section 147. Other parts of the fuel supply device 100 are similar in construction and operation to those of the fuel supply device 10 shown in FIGS. 1 and 2, so that their description will be omitted.

Figure 7:
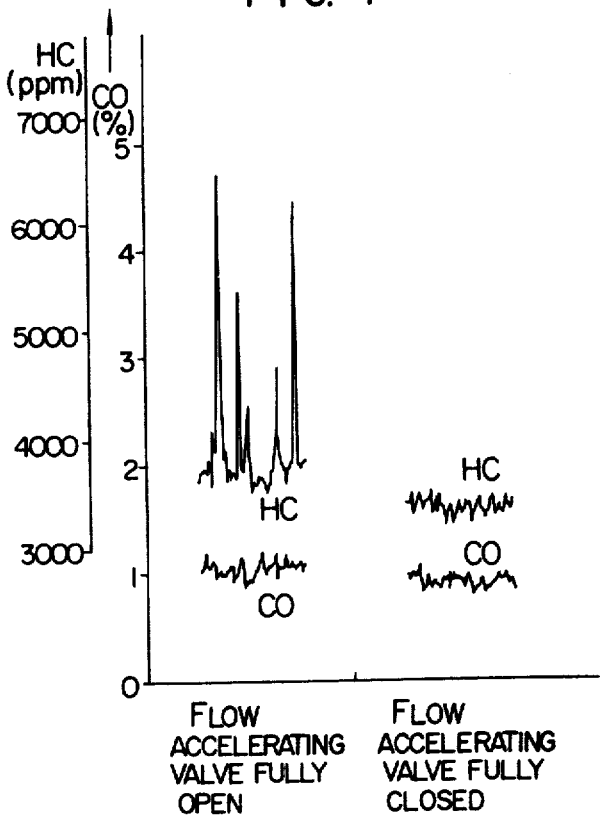
FIG. 7 is a graph showing the results of experiments conducted on the fuel supply device shown in FIG. 3, showing the relation between time and actually measured values of concentrations of the HC and CO in exhaust emissions with the flow accelerating valve being fully closed and fully open.

Experiments were conducted on the fuel supply device 100 shown in FIGS. 3 and 4 in many ways. The results of the experiments are shown in FIGS. 5–7.

Figure 5:
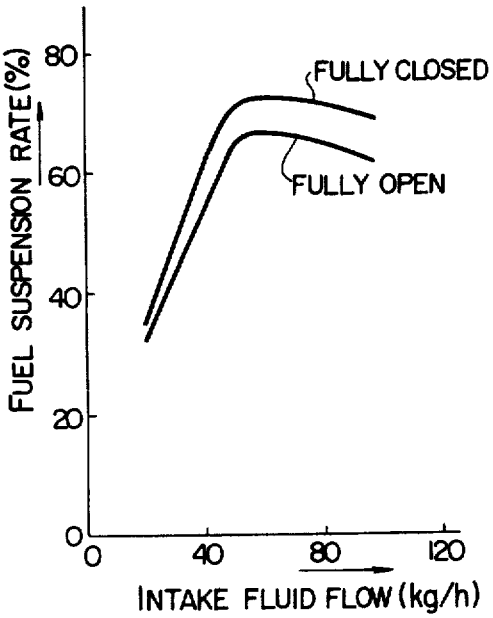
FIG. 5 is a graph showing the results of experiments conducted on the fuel supply device shown in FIG. 3, showing the relation between the intake fluid flow and the rate of fuel suspension of the liquid fuel in the air with the opening of the flow accelerating valve being used as a parameter.
Figure 6:
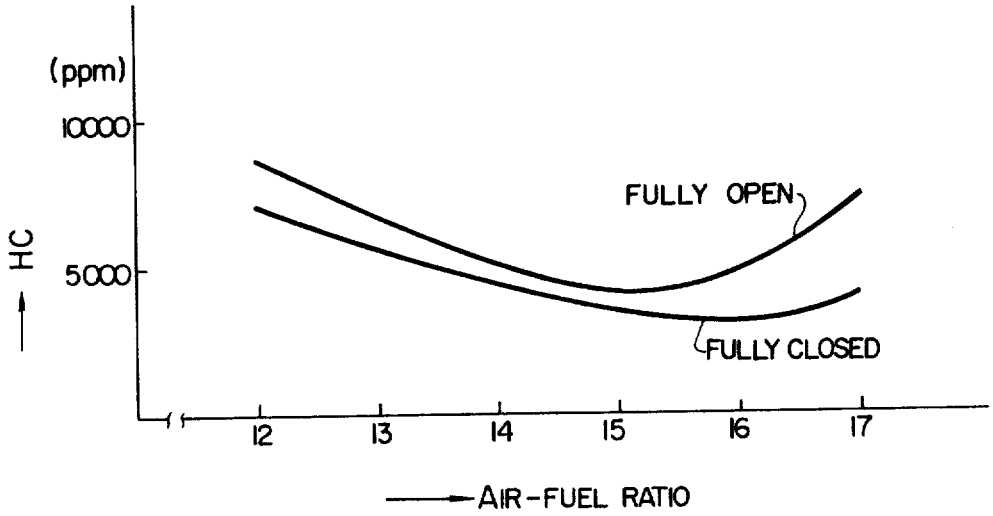
FIG. 6 is a graph showing the results of experiments carried out on the fuel supply device shown in FIG. 3, showing the relation between the air-fuel ratio and the mean value of concentration of the hydrocarbons in exhaust emissions with the opening of the flow accelerating valve being used as a parameter.

The graph shown in FIG. 5 shows the relation between the intake fluid flow which varies depending on the opening of the throttle valve 23 and the rate of fuel suspension of the liquid fuel injected into the intake fluid flow from the nozzle 53 when the flow accelerating valve 133 is forcedly moved to the fully closed position shown in solid lines and the fully open position shown in dash-and-dot lines in FIG. 3, in road-load condition in which the vehicle runs at constant speed on a flat road. The fluid suspension rate is obtained by the following equation:

$$\text{Fluid suspension rate } (\%) = [(Qf - Qf_1)/Qf] \times 100$$

$$Qf = Qf_1 + Qf_2$$

Where

Qf: volume of liquid fuel injected from nozzle 53.

$Qf_1$: volume of liquid fuel deposited on wall surface of intake passage 13 following fuel injection through nozzle 53.

$Qf_2$: volume of liquid fuel entrained in intake fluid flow following injection through nozzle 53 and introduced into engine.

FIG. 5 indicates that when the flow accelerating valve 133 is in its fully closed position the fuel suspension rate is higher than when the valve 133 is in its fully open position, i.e., when no flow accelerating valve is essentially provided. This would mean that the liquid fuel injected through the nozzle 53 into the intake fluid flow is satisfactorily atomized by the intake fluid flow accelerated by the flow accelerating valve 133, so that the liquid fuel is changed into a mist of uniformly broken-down minuscule particles to enable uniform fuel-air mixtures to be obtained. FIG. 5 also indicates that when the throttle valve 23 has its large opening and the intake fluid flow is large and has high speed, atomization of the liquid fuel is markedly promoted.

In FIG. 6, there is shown a graph showing the relation between the air-fuel ratio of the fuel-air mixtures supplied to the engine 21 and the mean value of concentration of HC (hydrocarbons) in exhaust emissions when the flow accelerating valve 133 is forcibly moved to its fully open position and its fully closed position at engine idling operation. FIG. 6 indicates that when the flow accelerating valve 133 is in its fully closed position, the HC concentration is lower than when the valve 133 is in its fully open position, i.e., when no flow accelerating valve is essentially provided, irrespective of the value of the air-fuel ratio. This would mean that the intake fluid flow accelerated by the flow accelerating valve 133 in its fully closed position sufficiently atomizes the liquid fuel injected through the nozzle 53 to increase the fuel suspension rate, to thereby form uniform fuel-air mixtures to enable the combustion in the combustion chambers of the engine 21 to take place effectively.

The graph shown in FIG. 7 shows the relation between time and the HC and CO (carbon monoxide) concentrations in exhaust emissions (actually measured values) when the flow accelerating valve 133 is forcibly moved to its fully open position and its fully closed position at engine idling operation. FIG. 7 indicates that HC and CO concentrations are lower when the flow accelerating valve 133 is in its fully closed position than when it is in fully open position, i.e., when no flow accelerating valve is essentially provided. FIG. 7 also indicates that the HC and CO concentrations show smaller variations when the flow accelerating valve 133 is fully closed than when it is fully open. A sudden variation in HC concentration occurring when the flow accelerating valve 133 is in its fully open position indicates that no uniform fuel-air mixtures are supplied to the combustion chambers of the engine 21.

What we claim is:

1. A fuel supply device for an internal combustion engine including an intake manifold, the fuel supply device comprising:

a throttle body defining therein an intake passage having one end thereof communicating with said intake manifold;

a throttle valve in said intake passage for controlling intake fluid flow introduced into the engine through said intake passage and said intake manifold;

flow accelerating means disposed in said intake passage upstream of said throttle valve, said flow accelerating means cooperating with the wall surface of said intake passage to define therein an accelerating flow passage having a flow area less than that of said intake passage, the intake fluid flow passing through said intake passage being accelerated when the intake fluid flow passes through said accelerating flow passage, said flow accelerating means being movable in response to a change in the intake fluid flow introduced into the engine through said intake passage between a fully closed position in which said accelerating flow passage has a minimum flow area and a fully open position in which said accelerating flow passage has a maximum flow area, to control the flow area of said accelerating flow passage; and a fuel injector having a nozzle disposed upstream of said throttle valve and downstream of said flow accelerating means when the flow accelerating means is in the fully closed position, said fuel injector being adapted to inject liquid fuel through said nozzle into the accelerated intake fluid flow passing through said accelerating flow passage and being disposed so as to be directed toward said accelerating flow passage such that the fuel injected from said injector does not substantially impinge against said flow accelerating means over the entire operating range of the engine.

2. A fuel supply device defined in claim 1, further comprising a wall member disposed in said accelerating flow passage to divide the same into a first flow passage section having a fixed flow area and a second flow passage section having a variable flow area.

3. A fuel supply device for an internal combustion engine including an intake manifold, the fuel supply device comprising:

a throttle body defining therein an intake passage having one end thereof communicating with said intake manifold;

a throttle valve in said intake passage for controlling intake fluid flow introduced into the engine through said intake passage and said intake manifold;

flow accelerating means disposed in said intake passage upstream of said throttle valve, said flow accelerating means cooperating with the wall surface of said intake passage to define therein an accelerating flow passage having a flow area less than that of said intake passage, the intake fluid flow passing through said intake passage being accelerated when the intake fluid flow passes through said accelerating flow passage, said flow accelerating means being movable in response to a change in the intake fluid flow introduced into the engine through said intake passage between a fully closed position in which said accelerating flow passage has a minimum flow area and a fully opened position in which said accelerating flow passage has a maximum flow area, to control the flow area of said accelerating flow passage;

the fuel injector having a nozzle disposed upstream of said throttle valve and downstream of said flow accelerating means when the flow accelerating means is in the fully closed position, said fuel injector injecting liquid fuel through said nozzle into the accelerated intake fluid flow passing through said accelerating flow passage; and a wall member disposed in said accelerating flow passage to divide the same into a first flow passage section having a fixed flow area and a second flow passage section having a variable flow area, said first flow passage section has a generally cylindrical downstream end portion, said nozzle of said fuel injector is disposed in said downstream end portion with an annular space left between said nozzle and a wall surface of said downstream end portion.

4. A fuel supply device defined in claim 3, wherein said nozzle of said fuel injector is disposed in substantially concentric relation to said downstream end portion of said first flow passage section.

5. A fuel supply device defined in claim 1, wherein said flow accelerating means includes a flat plate having an indentation cooperating with the wall surface of said intake passage to define said accelerating flow passage, and a shaft secured to said flat plate and rotatably supported by said throttle body, said shaft having an axis of rotation extending through said flat plate so as to divide said flat plate into two plate sections, one of said two plate sections having a surface area greater than a surface area of the other plate section, said indentation being provided in said one plate section.

6. A fuel supply device defined in any one of claims 2–4, wherein said flow accelerating means includes a flat plate having an indentation cooperating with the wall surface of said intake passage to define said accelerating flow passage, and a shaft secured to said flat plate and rotatably supported by said throttle body, said shaft having an axis of rotation extending through said flat plate so as to divide said flat plate into two plate sections, one of said two plate sections having a surface area greater than a surface area of the other plate section, said indentation being provided in said one plate section.

7. A fuel supply device defined in claim 6, wherein said indentation in said flat plate cooperates with said wall member to define said second flow passage section of said flow accelerating passage.

8. A fuel supply device defined in any one of claims 1–5, further comprising means for normally biasing said flow accelerating means into the fully closed position, said flow accelerating means being movable against said biasing means in response to an increase in the intake fluid flow introduced into the engine through said intake manifold from said fully closed position toward said fully opened position.

9. A fuel supply device defined in any one of claims 1–5, wherein said nozzle of said fuel injector is directed against said throttle valve.

10. A fuel supply device defined in claim 9, wherein said throttle valve includes a flat plate and a shaft secured thereto and rotatably supported by said throttle body, said shaft of said throttle valve having an axis of rotation extending through said throttle valve so as to divide said flat plate of said throttle valve into two plate sections, said nozzle of said fuel injector being directed to one of said two plate sections of said throttle valve that is remote from said nozzle.

11. A fuel supply device defined in any one of claims 1–5, wherein said fuel injector injects liquid fuel through said nozzle at an injection pressure of approximately 0.7–1.0 $Kg/cm^2$.

12. A fuel supply device defined in claim 10, wherein said fuel injector injects liquid fuel through said nozzle at an injection pressure of approximately 0.7–1.0 $Kg/cm^2$.

* * * * *